US005724801A

United States Patent [19]

Kogiso et al.

[11] Patent Number: 5,724,801

[45] Date of Patent: Mar. 10, 1998

[54] SYSTEM TO CONVEY BOBBINS BETWEEN ROVING FRAMES AND FINE SPINNING FRAMES

[75] Inventors: Takashi Kogiso, Mizunami; Noritaka Adachi, Ama-gun, both of Japan

[73] Assignee: Howa Machinery, Ltd., Japan

[21] Appl. No.: 761,480

[22] Filed: Dec. 6, 1996

Related U.S. Application Data

[63] Continuation of Ser. No. 435,422, May 10, 1995, abandoned.

[30] Foreign Application Priority Data

May 13, 1994 [JP] Japan ..... 6-124407

[51] Int. Cl.[6] ..... D01H 9/10; D01H 9/14

[52] U.S. Cl. ..... 57/281; 57/90; 57/268; 242/35.5 A

[58] Field of Search ..... 242/35.5 A, 36; 57/281, 90, 268

[56] References Cited

U.S. PATENT DOCUMENTS

| | | | |
|---|---|---|---|
| 3,828,682 | 8/1974 | Klein | 57/281 |
| 3,935,821 | 2/1976 | Maier et al. | 57/281 |
| 4,660,370 | 4/1987 | Matsui et al. | 242/35.5 A |
| 4,720,967 | 1/1988 | Guttler | 57/281 |
| 4,841,719 | 6/1989 | Sasaki et al. | 57/281 |
| 4,979,360 | 12/1990 | Kallmann et al. | 57/268 |
| 4,999,988 | 3/1991 | Roder et al. | 57/281 |
| 5,010,725 | 4/1991 | Yasui et al. | 57/281 |
| 5,365,728 | 11/1994 | Mack | 242/35.5 A |

FOREIGN PATENT DOCUMENTS

| | | | |
|---|---|---|---|
| 3817304 | 12/1988 | Germany | 57/281 |
| 52475 | 3/1985 | Japan | 242/35.5 A |
| 60-52475 | 3/1985 | Japan | 242/35.5 A |
| 62-62933 | 3/1987 | Japan . | |
| 62-170536 | 7/1987 | Japan . | |
| 64-61520 | 3/1989 | Japan . | |

*Primary Examiner*—William Stryjewski

*Attorney, Agent, or Firm*—Finnegan, Henderson, Farabow, Garrett & Dunner, L.L.P.

[57] ABSTRACT

A system to convey bobbins between a first overhead rail 4 looping along fine spinning frames 1A to 1M and a second overhead rail 6 connected to roving frames 2A and 2B. The first overhead rail 4 is constructed as a single loop arranged all along the fine spinning frame, while the second overhead rail 6 is constructed as a single loop arranged around the roving frames 2A and 2B. The first and second overhead rails 4 and 6 are connected by a branched rail 7 for returning a bobbin carriage 10 with empty bobbins 12 and by a branched rail 8 for supplying a bobbin carriage 10 with full bobbins 11.

8 Claims, 13 Drawing Sheets

SYSTEM TO CONVEY BOBBINS BETWEEN ROVING FRAMES AND FINE SPINNING FRAMES

This application is a continuation of application Ser. No. 08/435,422 filed May 10, 1995, now abandoned.

BACKGROUND OF THE INVENTION

1. Field of the Invention

The present invention relates to a system for transferring roving bobbins between roving frames and fine spinning frames in a spinning plant.

2. Description of the Related Art

A system for transferring roving bobbins between roving frames and fine spinning frames in a spinning plant is known. In said system provision is made of a first overhead rail for bobbins, which is looped around the fine spinning frames, and a second overhead rail for bobbins, on which a loading station is provided for full bobbins from roving frames, and wherein the first and second overhead rails are connected with each other by means of a branched overhead rail for returning empty bobbins from the first overhead rail to the second overhead rail and a branched overhead rail for supplying full bobbins from the second overhead rail to the first overhead rail. This system is disclosed in Japanese Unexamined Patent Publication (Kokai) No. 62-170536.

In Unexamined Patent Publication No. 62-170536, the first overhead rail includes a closed section looped around the respective fine spinning frames, which section is connected to the second overhead rail connected to the roving frames. A plurality of bobbin carriers (trolleys) are suspended from the rails so as to be moved along the rails. Namely, each of the trolleys is provided with wheels on the rails and an electric motor connected to the wheels for causing the latter to be rotated, so that the trolley is moved along the rails. Furthermore, each of the trolleys is provided with a bobbin hanger.

The trolleys on the first overhead rails are usually moved along the closed loop along the respective fine spinning frames. When a bobbin in a creel of a fine spinning frame is emptied, the emptied bobbin is manually or automatically exchanged with a full bobbin taken from a trolley, while the empty bobbin taken from the creel is put on to a trolley not occupied by a bobbin. In the second overhead rail, full bobbins are loaded onto trolleys moving along the second overhead rail at the loading station. Furthermore, at the loading station, empty bobbin are also discharged. At the locations where the second overhead rail is connected to the full bobbin supplying rails, switching devices are provided. Upstream from these locations, a full bobbin detector is provided for detecting if a bobbin on a coming trolley is a full bobbin or an empty bobbin. When it is determined that the bobbin on the incoming trolley is full bobbin and that a full bobbin is required at a first overhead rail, a corresponding switching device is operated, so that the trolley with a full bobbin from the second overhead rail is introduced, via a corresponding full bobbin supply rail, into the first overhead rail. Contrary to this, when it is determined that the bobbin on the incoming trolley is an empty bobbin or that a full bobbin is not required at a first overhead rail, a corresponding switching device is de-energized, thereby prohibiting the introduction of the incoming trolley, from the first overhead rail, to the first overhead rail.

At the locations where the first overhead rail is connected to the empty bobbin return rails, switching devices are respectively provided. Upstream from these locations, a bobbin detector is provided for detecting if a bobbin on a coming trolley is a full bobbin or an empty bobbin. When it is determined that the bobbin on the incoming trolley is an empty bobbin, a corresponding switching device is operated, so that the trolley with the empty bobbin from the first overhead rail is returned, via a corresponding empty bobbin return rail, into the second overhead rail. Contrary to this, when it is determined that the bobbin on the coming trolley is a full bobbin, a corresponding switching device is de-energized, thereby allowing the trolley with the full bobbin to move on the closed loop around the fine spinning frame.

In the prior art, the first overhead rails are provided so as to loop around corresponding fine spinning frames. As a result, branched overhead rails for supplying full bobbins and the branched overhead rails for returning empty bobbins are provided so that they are branched from the respective first overhead rails. Thus, switching devices are necessary for every location where the branched rails are connected to the overhead rails. Thus, a switching control of the switching devices is complicated. Furthermore, the provision of the loading station for exchanging the empty bobbins from the fine spinning frames with the full bobbins from the roving frames makes the loading operation time consuming. In other words, there is a requirement that the number of the branched rails for returning empty bobbins and for supplying full bobbins are reduced, and that any bobbin exchanging operations can be eliminated.

Furthermore, in the prior art, each of the trolleys for hanging a series of bobbins is provided with an electric motor to allow it to be moved along the overhead rail. In other words, in the prior art, a large number of such electric motors are necessary, thereby increasing a cost of the total system, on one hand, and increasing chances of occurrence of malfunction of the system, on the other hands. In view of these drawbacks, the prior art (Japanese Unexamined Patent Publication No. 62-170536) has also proposed a conveyor system, wherein the trolleys are provided with disks, which are arranged at a predetermined pitch and which are in contact with each other. A transferring device including a cylinder is provided, which causes the disks to be pushed by the cylinder device, so that an intermittent movement for a length corresponding to the pitch is obtained, without providing an electric motor on each of the trolleys.

However, in this system, a continuous arrangement of the trolleys along the entire length of the overhead rails is essential in order to allow the trolleys to be moved. In other words, extra trolleys must be located on corner portions of the overhead rails at ends of fine spinning frames, where no creel exists and thus no exchange of bobbins is done. In other words, it is required that any unnecessary trolleys, which are useless for bobbin exchange operations, are eliminated.

SUMMARY OF THE INVENTION

An object of the present invention is to provide a conveyor system capable of reducing the number of branched overhead rails between the first and second overhead rails.

Another object of the present invention is to provide a conveyor system capable of eliminating unnecessary trolleys.

According to the present invention, a conveyor system is provided for transporting bobbins between a roving operation area provided with at least one roving frame and a fine spinning operation area provided with a plurality of fine spinning frames, comprising:

a plurality of bobbin carriages for carrying bobbins;

first overhead means for conveying the bobbin carriages in the fine spinning operation area;

second overhead means for conveying the bobbin carriages in the roving spinning operation area;

first branched means for connecting the first and second overhead means for transporting the bobbin carriages with the bobbins from the first overhead means to the second overhead means;

a second branched means for connecting the first and second overhead means for transporting the bobbin carriages with the bobbins from the second overhead means to the first overhead means, and;

means for moving the bobbin carriages along the first and second overhead means as well as the first and second branched means;

said first overhead means comprising a single overhead rail constructing a single closed loop which loops around all of the fine spinning frames of the fine spinning operation area;

said second overhead means comprising a single overhead rail constructing a single closed loop which is arranged around the at least one roving frame of the roving spinning operation area, and at least one doffing rail arranged along the corresponding roving frame.

According to the present invention, the first overhead means is constructed by a single overhead rail in a single closed loop which loops around all of the fine spinning frames of the fine spinning operation area, and the second overhead means is constructed by a single overhead rail in a single closed loop which is arranged around the at least one roving frame of the roving spinning operation area, and at least one doffing rail arranged along the corresponding roving frame. As a result, a single branched rail is sufficient for returning bobbins from the first rail to the second rail or supplying bobbins from the second rail to the first rail. Thus, the number of the branched rails are reduced, on one hand, and the number of switching devices is reduced, on the other hand. Furthermore, the control of the switching devices is simplified. Furthermore, according to the invention, the doffing rail of the roving frame is connected with the second overhead rail. Thus, a bobbin carriage with bobbins can be directly transported between the roving frames and the fine spinning frames, thereby eliminating the loading station in the prior art (Japanese Unexamined Patent Publication No. 62-170536). Furthermore, an increase in a labor efficiency is obtained since a manual bobbin-loading operation, between the loading station and the roving frames, is unnecessary.

In a preferred embodiment, each of said bobbin carriages comprises a plurality of carriage members, each of which is provided with bobbin hangers, and means for flexibly connecting the carriage members with each other in series, and wherein said bobbin carriage moving means comprise a plurality of spaced feeders arranged along the first and second overhead means, a spacing between the adjacent feeders being larger than a single length of the bobbin carriage, each of the feeders comprising a rotating member which is in contact with the carriage members and a source of a rotating movement to be applied to the rotating member. This arrangement is advantageous in that the number of feeders can be reduced. Furthermore, a continuous arrangement of bobbin carriages along the entire length of the overhead rails is unnecessary and a positive transportation of the bobbin carriages is possible while the total number of the bobbin carriages is reduced.

Advantageously, each of the first and second branched means comprises an overhead rail having a length larger than the length of a single bobbin carriage. As a result, the first and second branched means can function as storage, of a unit of length, for a bobbin carriage. In other words, in a situation that the return of a bobbin carriage from first overhead rail to the second overhead rail or a supply of a bobbin carriage from the second overhead rail to the first overhear rail is prohibited, the branched means can be used as a storage, which allows the timing of the return or feed of the bobbin carriage to be suitably controlled, thereby realizing a desired bobbin transportation operation.

Advantageously, the fine spinning frames in the fine spinning operation area are arranged in a row, each of the fine spinning frames comprising a creel for the bobbins and spinning parts for roving from corresponding bobbins on the creel, wherein the overhead rail of the first overhead means has sections looped around the fine spinning frames alternately along the direction of the row of the fine spinning frames, so that the looped sections of the first overhead rail are supported by the creels of the corresponding fine spinning frames, and wherein auxiliary bobbin hangers are provided at the fine spinning frames with no provision of the looped sections of the first overhead means. When a random bobbin exchange operation is executed, the full bobbin on the bobbin carriages are loaded to the auxiliary hangers. As a result, a bobbin exchange can be made with the full bobbins on the auxiliary hangers, without waiting for the arrival of a bobbin carriage, thereby increasing the bobbin transportation efficiency.

BRIEF DESCRIPTION OF ATTACHED DRAWINGS

DETAILED DESCRIPTION OF PREFERRED EMBODIMENTS

Figure 1:
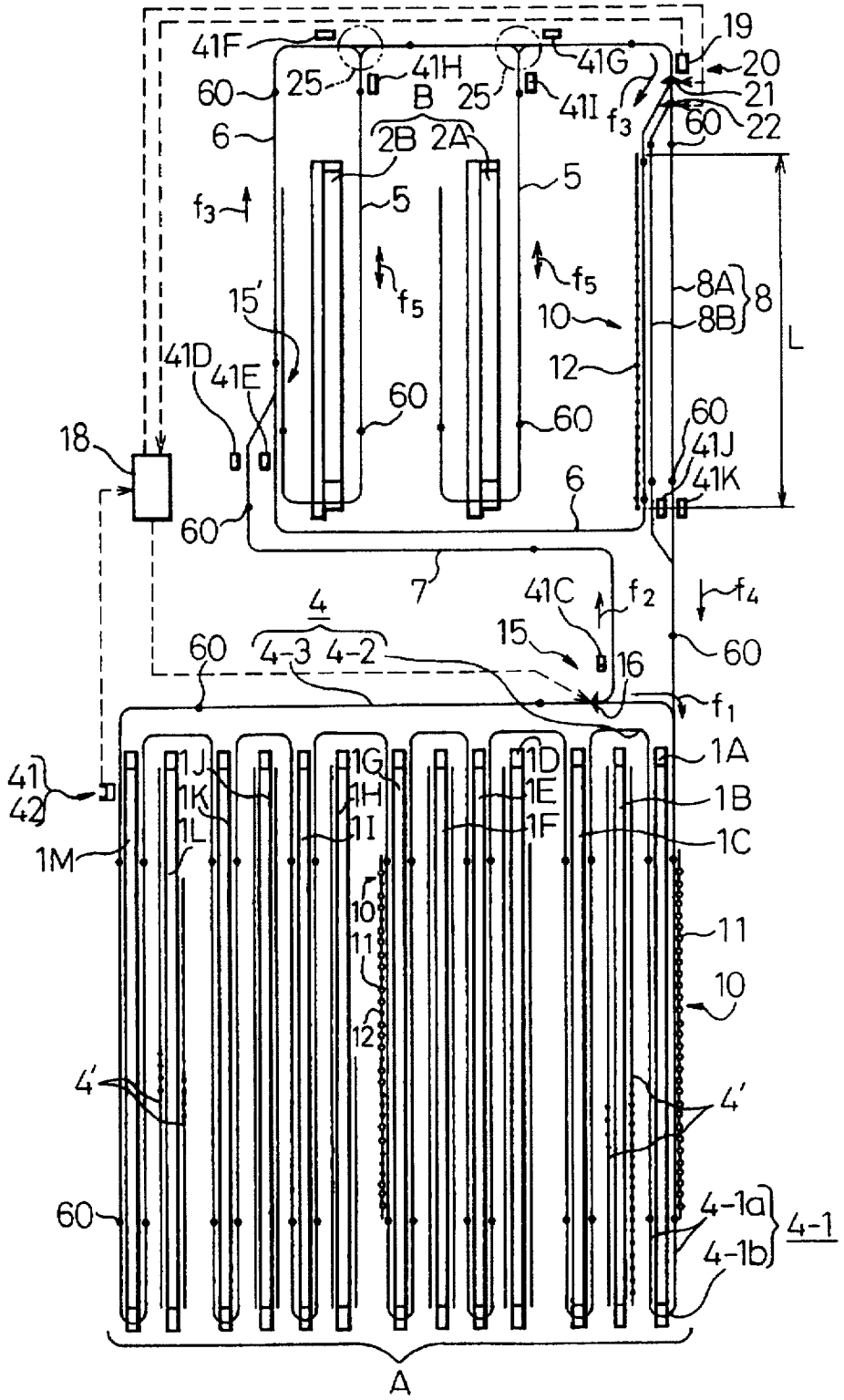
FIG. 1 is a schematic general view of a conveyor system according to the present invention.
Figure 2:
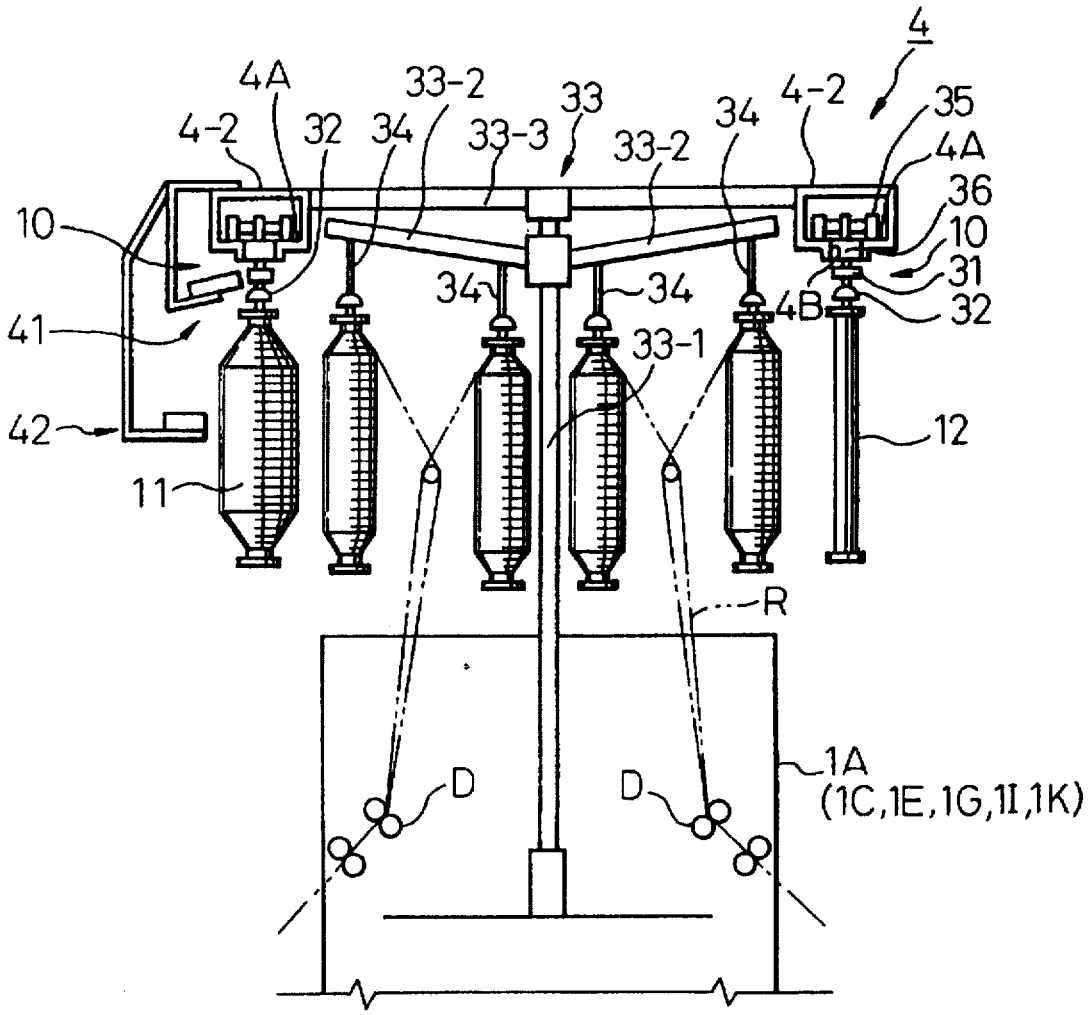
FIG. 2 illustrates a creel of a fine spinning frame with an overhead rail according to the present invention.

Now, an embodiment of the present invention will be explained with reference to attached drawings. In FIG. 1, in a spinning plant, a fine spinning area A including a plurality (thirteen in this embodiment) of fine spinning frames 1A to 1M and a roving spinning area B including a plurality (2 in this embodiment) of roving frames 2A and 2B are arranged so that the areas A and B are adjacent with each other in the spinning plant. As shown in FIG. 2, each of the fine spinning frames, as is well known, includes laterally spaced double rows of spinning sections spaced along the length of the frame, which includes a drafting roller unit D supplied by a roving R from a bobbin supported on a creel 33, so that the roving R is subjected to drafting and spinning for twisting the drafted roving to a thread while winding the latter on a cop for creating a package of the thread on the cop. As well known manner, the creel 33 includes upright posts 33-1 and supporting members 33-2, extending from the post 33-1. The supporting members 33-2 are provided with bobbin hangers 34, which are arranged along the length of the fine spinning frame in such a manner that two rows of bobbin hangers 34 are created on both sides of the central posts 33-1. Namely, the rovings from the hangers 34 on the creel 33 are fed to the respective spinning section of the fine spinning frame.

According to the present invention, a system for transporting roving bobbins is provided between the fine spinning frame 1A to 1M and the roving frames 2A and 2B. As shown in FIG. 1, the conveyor system comprises a first overhead rail 4 having a single loop above all of the fine spinning frames of the spinning area A. Namely, the first overhead rail 4 is comprised of a looped section 4-1 looped around the fine spinning frames 1A, 1C, 1E, 1G, 1I, 1K and 1M, respectively, each of which is constructed by a pair of straight parts 4-1*a* which are parallel to the length of the fine spinning frame, and a looped part 4-1*b* looped around an end of a corresponding flyer frame, connecting sections 4-2, which connect adjacent loop sections 4-1 with each other, while passing by ends of the fine spinning frames 1B, 1D, 1F, 1H, 1J, and 1L, and a straight section 4-3 connecting the first and the last looped sections. As a result, a single loop of the overhead rail, which passes all of the sides of the fine spinning frames 1A to 1M, is created. A plurality of bobbin carriages 10, each of which is provided with a series of hangers for bobbins, move along the overhead rail 4. In FIG. 1, a full bobbin is designated by a reference numeral 11 and is illustrated by a larger circle not filled, while an empty bobbin is designated by a reference numeral 12 and is illustrated by a smaller circle filled with black.

As shown in FIG. 2, the creels 33 of the fine spinning frames 1A, 1C, 1E, 1G, 1I, 1K and 1M covered by the looped sections 4-1 of the first overhead conveyor 4 are provided with support members 33-3 extending horizontally from the post 33-1 at locations above the supporting members 33-2. As shown in FIG. 1, a desired number of auxiliary bobbin hangers 4' are arranged on both sides of the fine spinning frames 1B, 1D, 1F, 1H, 1J not covered by the looped sections 4-1 of the first overhead conveyor 4. The auxiliary bobbin hangers 4' are fixedly connected to overhead rails connected to ends of corresponding support members 33-3 of corresponding fine spinning frames 1B, 1D, 1F, 1H and 1J. During the movement of bobbin carriages along the closed loop of the first overhead rail 4 a so-called "random" bobbin exchange operation is executed. Namely, each time when an empty bobbin on any creel 33 of a fine spining frame is found by an operator(s), the empty bobbin is exchanged with a full bobbin on an adjacent bobbin carriage 10. When almost all of the full bobbins on a bobbin carriage are exhausted, full bobbins remaining on the bobbin carriage 10 are moved to an adjacent auxiliary bobbin hanger 4'. As a result, the bobbin carriage 10 is brought to a fully emptied condition, which allows the bobbin carriage 10 to be moved onto a second overhead rail 6. Thus, at the locations of the auxiliary bobbin hanger 4', a random bobbin exchange operation can be done without waiting for the arrival of a bobbin carriage 10.

In the roving area B, the second overhead rail 6 is arranged so that it forms a loop encircling the two roving frames 2A and 2B. Doffing rails 5 are branched from the second overhead rail 6 via respective switching devices 25. At location above the roving frames, the doffing rails 5, first, extend along front sides of respective roving frames, then, loop around the respective ends of the roving frames, and further extend along rear sides of the respective roving frame. Each of the switching devices 25 is switched between a first position, where an empty bobbin carriage 10 from the second overhead rail is introduced into a doffing rail 5 and a second position, where the second overhead rails 6 and the doffing rails 5 are disconnected, so that bobbin carriages 10 on the second overhead rails 6 move along the closed loop, and a second position where a bobbin carriage 10 is moved between the second overhead rail 6 and the doffing rails 5. Advantageously, each of the roving frames 2A and 2B can be provided with an automated doffing system. Namely, when a full bobbin state is obtained in the roving frame, the latter is stopped, and the doffing system operates to automatically exchange the full bobbins on bobbin holders (not shown) of the roving frame with empty bobbins from a bobbin carriage 10. Then, an operation for obtaining a roving and winding the latter onto a respective bobbin is commenced. During the doffing operation, full bobbins in the roving frame are taken out from the corresponding bobbin wheels and put into bobbin hangers of a bobbin carriage 10 located at the corresponding doffing rail 5.

The first overhead conveyor 4 and the second overhead conveyor 6 are connected with each other by means of an overhead rail 7 for returning a bobbin carriage 10 with empty bobbins from the first overhead rail 4 to the second overhead rail 6 and an overhead rail 8 for introducing a bobbin carriage 10 with full bobbins from the second overhead rail 6 to the first overhead rail 4. Namely, the overhead rail 7 for returning the bobbin carriage 10 with empty bobbins branches, at a location 15, from the straight section 4-3 of the first overhead rail 4 and is, at a location 15', connected to the second overhead rail 6. The overhead rail 8 for supplying the bobbin carriage 10 with full bobbins branches from the second overhead rail at a location 20 and is connected to the first overhead rail 4 at a location adjacent to the inlet to the first fine spinning frame 1A. On the overhead rails 4, 5, 6, 7 and 8, the bobbin carriages 10 move as shown by arrows, while full bobbins 10 and empty bobbins hang from the bobbin carriages. The branched overhead rail 7 for returning carriages has a length between the ends 15 and 15' longer than a length L of the single carriage 10, so that the full length of the carriage can be received by the rail 7.

At the location 15, where the returning overhead rail 7 branches from the first overhead rail 4, a switching device 16 is arranged for changing the direction of a movement of a carriage 10 from the first rail 4 to the returning rail 7. The construction of the switching device 16 is itself well known as is described in, for example, Japanese Unexamined Patent Publication No. 1-61520. Namely, the carriages 10 move, usually, along the closed loop of the first rail 4 as shown by an arrow $f_1$. However, when all of the full bobbins 11 on a carriage 10 are consumed and changed to empty bobbins 12, the switching device 16 is operated so that the carriage is moved onto the returning overhead rail as shown by an arrow $f_2$. Sensors 41 and 42 are arranged at a location upstream from the location 15 in the direction of the movement of the carriages 10 on the first overhead rail 4. Namely, the sensor 41 detects an arrival of a leading end of a carriage 10. A sensor 42 detects whether or not a bobbin, suspended from the carriage 10 and detected by the sensor 41, is fully emptied. A control circuit 18 as a sequential circuit or microcomputer unit is provided for receiving signals from the sensors 41 and 42. The control circuit 18 is provided with a logic circuit or a program for issuing a signal directed to the switching device 16 for switching the movement of a bobbin carriage 10 on the first rail 4 to move on to the returning conveyor 7 only when it is detected that all of the bobbins on the bobbin carriage 10 are empty bobbins 12 as a result of a random bobbin exchanging operation executed manually by an operator(s) during the recirculation of the carriage on the closed loop of the first rail 4. In other words, the operation of the control circuit 18 is such that, even when only one full bobbin exists on a bobbin carriage 10, an actuation of the switching operation of the switching device 16 is prohibited.

In FIG. 1, the overhead rail 8 for returning a bobbin carriage loaded with full bobbins 11 is constructed by a main rail 8A which branches from the second overhead rail 5 at location 20 and is connected to the first overhead rail 4 and has a length larger than the full length L of a bobbin carriage 10, and an auxiliary rail 8B for storage of a bobbin carriage which is parallel to the main rail 8A and has a length larger than the full length L of a bobbin carriage 10. In other words, two bobbin carriages 10 are supported, in parallel, by the overhead rail 8. It is, of course, possible to eliminate the auxiliary rail 8B. At the location 20, where the second overhead rail 6 is connected to the bobbin supply overhead rail 8, a switching device 21 is arranged. Furthermore, at the location of the bobbin supply overhead rail 8, where the main rail 8A and auxiliary rail 8B are connected, another switching device 22 is arranged. The switching device 21 is for changing a direction of the movement of a bobbin carriage 10 from the second overhead rail 6 to the branched overhead rail 8. The switching device 22 is for switching an introduction of a bobbin carriage 10 between the main rail 8A and the reservoir rail 8B. A discrimination device 19 is arranged at a position on the second overhead rail 6 adjacent the location 20, and issues a signal indicating that a bobbin at a front end of a bobbin carriage arrived at the location 20 of the second overhead rail 6 is a full bobbin 11 or an empty bobbin 12. The signal is input to the control circuit 18. When it is determined that the bobbin at the inlet end of the coming bobbin carriage 10 is an empty bobbin 12, the operation of the switching device 21 is prohibited, so that a movement of the carriage 10 along the second overhead rail 6 as shown by an arrow $f_3$ is continued. When it is determined that the bobbin at the inlet end of the coming bobbin carriage 10 is a full bobbin 11, the switching device 21 is operated, so that the carriage 10 is now moved onto the bobbin carriage supply conveyor 8. Then, the switching device 22 is operated in such a manner that the bobbin carriage 10 with full bobbins 11 is introduced into a main rail 8A or 8B which is not occupied by a bobbin carriage 10. The discrimination device 19 has the same construction as that of the bobbin detecting device 42, and will be fully explained later.

Figure 3:
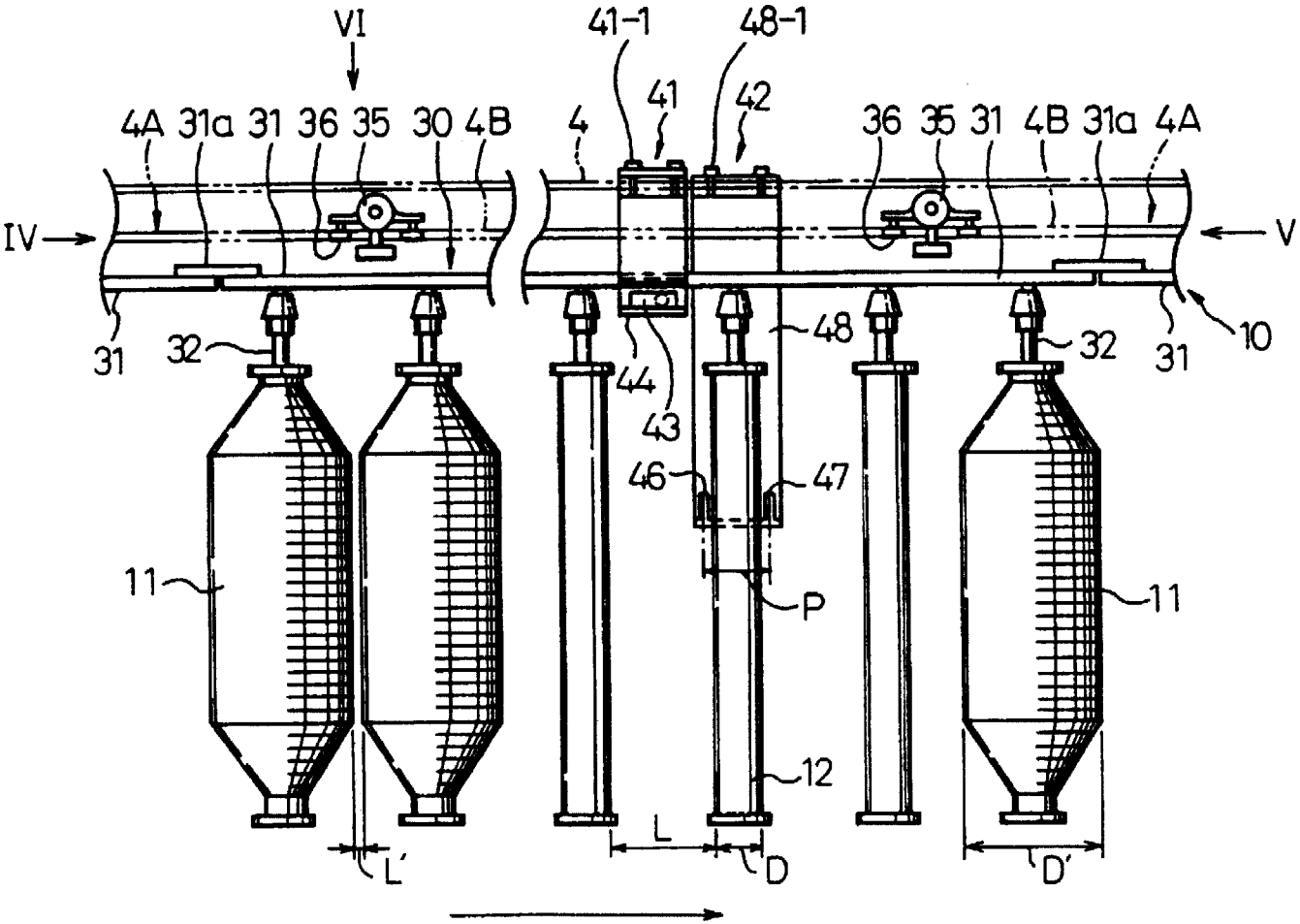
FIG. 3 illustrates a side view of the overhead rail with bobbin carriage with bobbins.

Now, the construction of the bobbin carriage will be explained. Namely, as shown in FIG. 3, each of the bobbin carriages 10 includes a series of carriage units 30, each of which is constructed by a carriage bar 31 and a plurality of bobbin hangers 32 mounted on a bottom surface of the carriage bar 31. The construction of the bobbin hanger 32 is well known, and thus a detailed explanation is omitted. The carriage bar 31, which is adjacent to other carriage bars 31, is connected to other carriage bars 31 by means of joints **31*a*, which allow the adjacent carriage bars 31 to be pivoted with each other. As a result of the pivotable connection of the carriage bars 31, a flexible construction of the bobbin carriage 10 is created, which allows the bobbin carriage 10 to move on curved portions in the overhead rails 4, 5, 6, 7 and 8. A pitch of the bobbin hangers 32, i.e., the distance between adjacent bobbin hangers 32 is equal to a pitch of the bobbin hangers 34 of the creel 33 of the fine spinning frame. Furthermore, a length of the single bobbin carriage 10, i.e., the number of the carriage units 30 in the single carriage 10 is such that the total number of the bobbin in the single carriage 10 is equal to the total number of roving bobbins, i.e., the total number of the bobbin wheels included in the single roving frame 2A or 2B**.

Each of the carriage bars 31 includes, at its ends, roller units, each of which is constructed by a pair of supporting rollers 35 and a pair of spaced guide rollers 36. The supporting rollers 35 have an axis of rotation extending horizontally, while the guide roller 36 has an axis of rotation extending vertically, which allows the carriage 10 to be moved along the rails 4, 5, 6, 7 and 8. Namely, each of the rails 4, 5, 6, 7 and 8 has, as shown with reference to the rail 4, a substantially C cross-sectional shape, opened downwardly. Thus, the rail is formed with a pair of horizontal supporting surfaces 4A, on which the supporting rollers 35 of the carriage bars 31 of the carriage units 30 of each carriage 10 are supported. The rail 4 is further formed with a pair of faced vertical guide surfaces 4B, between which the guide rollers 36 of the carriage bars 31 of the carriage units 30 of each carriage 10 are guided. As a result, the carriage 10 moved along the rails 4, 5, 6, 7 and 8, while the carriage 10 is supported by the supporting rollers 34 and guided by the guide rollers 36.

Figure 5:
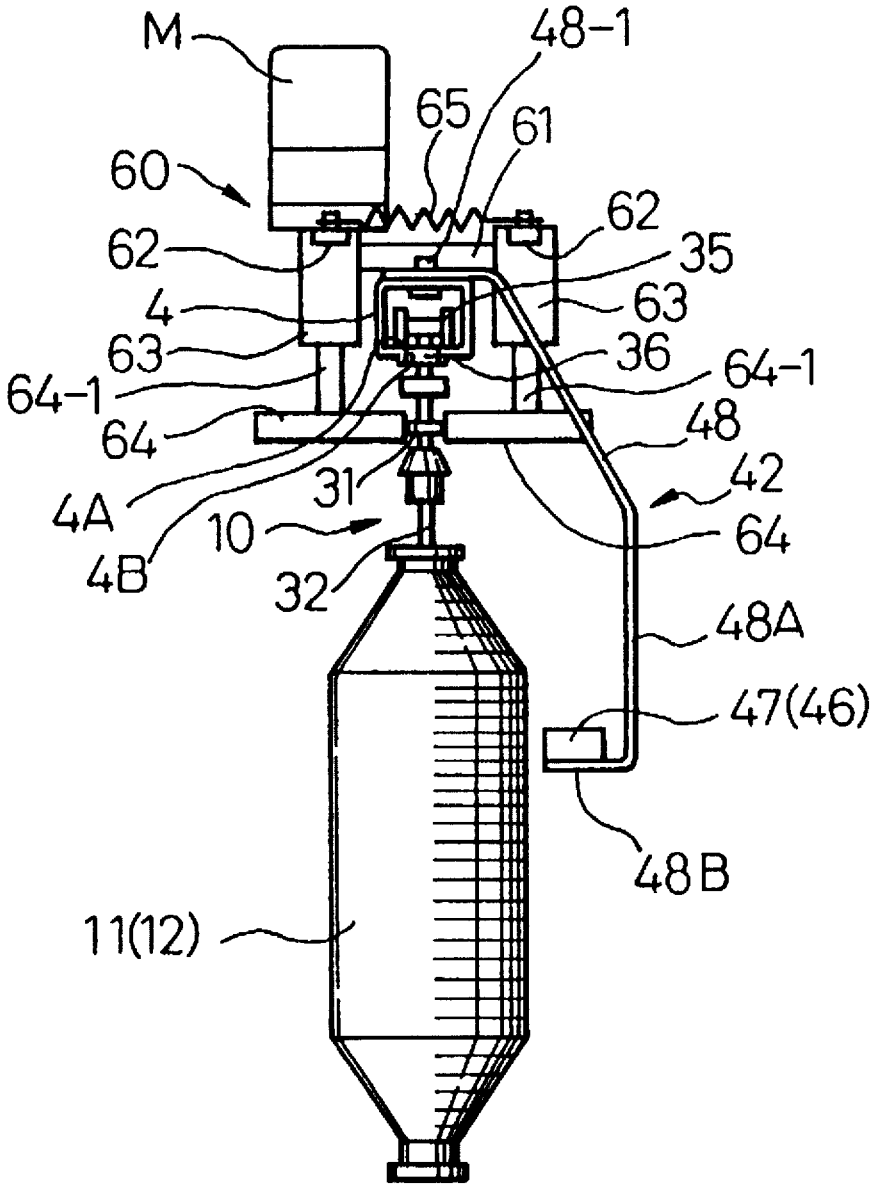
FIG. 5 is a view taken along line V in FIG. 3.
Figure 6:
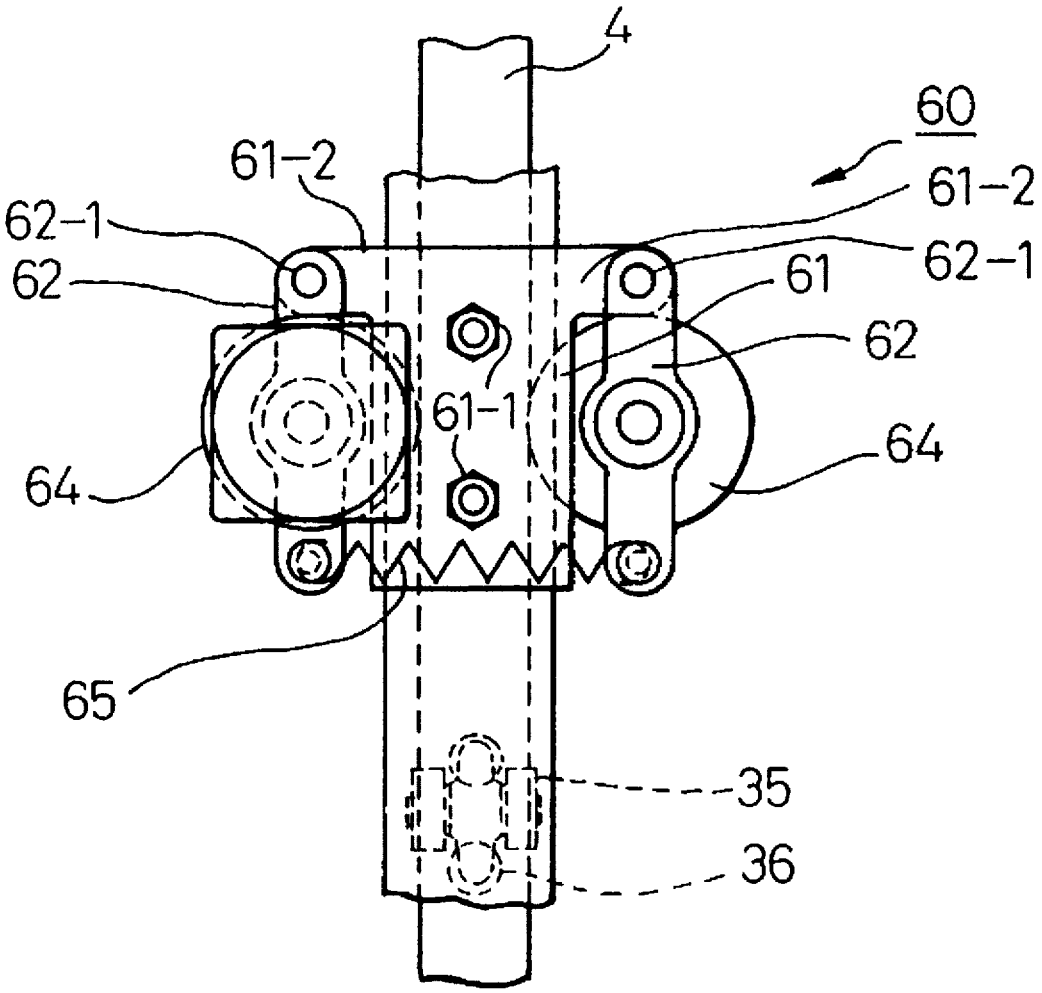
FIG. 6 is a view taken along line VI—VI in FIG. 3.

As disclosed in a Japanese Unexamined Patent Publication No. 1-61520, a plurality of feeders 60 are arranged along the rails 4, 5, 6, 7 and 8 at a pitch which is shorter than the length L of the single bobbin carriage 10, so that the bobbin carriage 10 can be moved along the rails 4, 6, 7 and 8 in one direction as shown by arrows $f_1$, $f_2$, $f_3$ and $f_4$ in FIG. 1, and can be reciprocally moved along the doffing rail 5 as shown by arrow $f_5$. The construction of the feeder 60 is explained with reference to that provided at the first overhead rail 4. As shown in FIGS. 5 and 6, a bracket 61 is fixedly connected to the overhead rail 4 by means of bolts and nuts 61-1. The bracket 61 is formed with a pair of lugs 61-2, which oppositely extend in a horizontal plane. Swing arms 62 are, at their ends, connected to the respective lugs 61-2 by means of respective pins 62-1, which extend vertically, so that the swing arms 62 are, in a horizontal plane, pivotable about axis of the respective pins 62-1. Journal boxes 63 (FIG. 5), which extend vertically, are connected to the respective swing arms 62, and disks 64 are, at their shaft portion 64-1, rotatably supported to the respective journal boxes 63. A drive motor M is, at its drive shaft (not shown), connected to the shaft 64-1 of one of the disks 64 (drive disk). As shown in FIG. 5, the disks 64 face, at their circumferential wall, the side surface of the carriage bar 31.

A coil spring 65 is arranged between ends of the swing arms 62 opposite the respective pins 62-1, so that the disks 64 are urged to be contacted with the opposite side surfaces of the carriage bar 31. As a result, the rotating movement applied to the shaft of the drive disk 64 causes the carriage bar 31 engaged between the disks 64 to be moved along the direction of the length of the rail 4. Thus, the single carriage 10 can be, along the rails 4, 5, 6 and 7, relayed or moved between the feeders 60, which are located adjacent with each other at a distance slightly shorter than the length L of the bobbin carriage 10.

Figure 4:
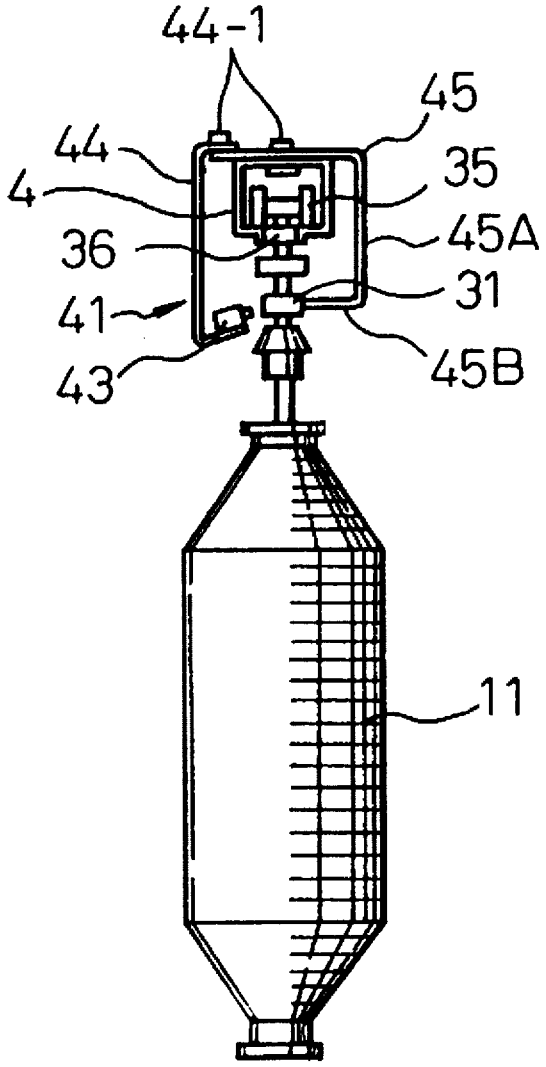
FIG. 4 is a view taken along line IV in FIG. 3.

Now, a construction of the carriage detector 41 for detecting whether or not the bobbin carriage 10 exists and the bobbin detector 42 for detecting a full bobbin 11 and an empty bobbin 12 hanged from the bobbin carriage 10. As shown in FIG. 1, the carriage detector 41 and the bobbin detector 42 are arranged at locations upstream from the switching device 16 in the direction (arrow f1) of the movement of the bobbin carriages 10. From the switching device 16, at a distance slightly longer than the length of the bobbin carriage 10, the carriage detector 41 and, then, the bobbin detector 42 are arranged. See also FIG. 3. As shown in FIG. 4, the carriage detector 41 includes a adjacent switch 43 for detecting an existence of a carriage bar 31 of a bobbin carriage 10. Namely, a guide bracket 45 of a substantially C shape is connected to the rail 4 by means of bolts 41-1. The guide bracket 45 has a side plate 45A and a guide plate 45B integrally extending from the side plate 45A. A second bracket 44 is connected to the guide bracket 45 by means of bolts 44-1, so that the second bracket extends substantially vertically parallel to the side plate 45A of the guide bracket 45. The adjacent switch 43 is connected to the bracket 44 at its bottom end, so that a detecting part of the switch 43 faces a side surface of the carriage bar 31. Contrary to this, the guide plate 45B extends horizontally, so that the plate 45B is in contact with the carriage bar 31 at a surface opposite the switch 43. As a result, during the movement along the rail 4, the carriage bar 31 is guided by the guide plate 45B, thereby maintaining a desired spacing between the adjacent switch 43 and the carriage bar 31.

Carriage detectors of a construction similar to the carriage detector 41 are also provided at locations where the overhead rails 5, 6 and 8 are connected. Namely, at locations where the second overhead rail 6 is connected to the doffing rails 5, carriage defectors 41F and 41H, and 41G and 41I are arranged in similar manner as shown in FIG. 4. At a location where the first overhead conveyor 4 is connected to the branched overhead rail 7 for returning bobbin carriages, a similar carriage detector 41C is arranged. At locations where the branched rail 7 is connected to the second overhead rail 6, carriage detectors 41D and 41E are arranged. Finally, at locations where the main rail 8A and the auxiliary rails 8B are connected, carriage detectors 41J and 41K are arranged.

Figure 7:
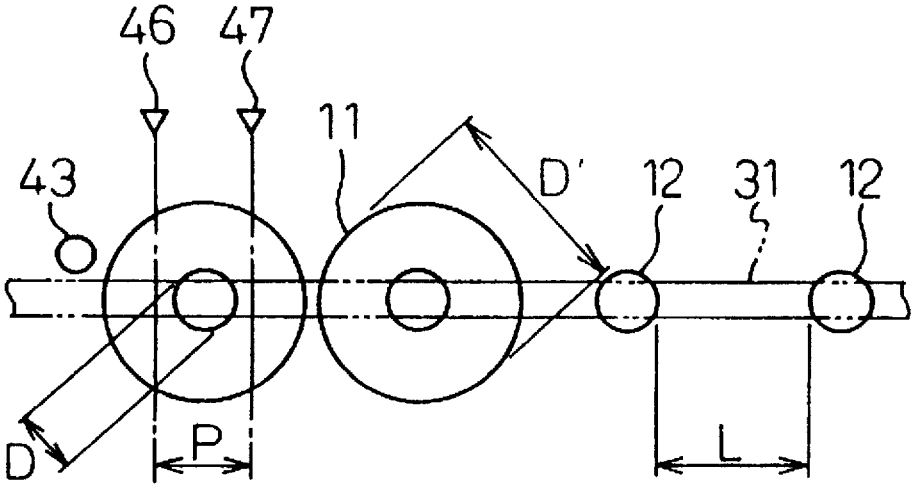
FIG. 7 illustrates an arrangement of bobbin detectors with respect to bobbins on a bobbin carriage.

The bobbin detector 42, which is arranged slightly upstream from the carriage detector 41 as shown in FIGS. 3 and 7, includes a pair of switches 46 and 47, each of which is constructed as a photo-electric transducer. As shown in FIG. 5, a bracket 48 is, at the top end, connected to the upper part of the rail 4 by means of bolts 48-1. The bracket 48 has a side plate 48A, which extends downwardly to a position, which corresponds to a medium height of a bobbin (a full bobbin 11 or an empty bobbin 12). At the bottom of the side plate 48A, an integral bottom plate 48B extends horizontally to a position which is spaced even from an outer surface of the full bobbin 11. The photo-electric switches 46 and 47 are mounted on the bottom plate 48B by a suitable means. As shown in FIGS. 3 and 7, the arrangement of the photo-electric switches 46 and 47 are such that they are spaced at a distance P which is larger than the diameter D of the empty bobbin 12 and a distance L' between the full bobbins 11 and which is smaller than the distance L between empty bobbins 12 which are adjacent with each other as well as the diameter D' of the full bobbin 11. See also FIG. 7.

Now, the operation of the roving bobbin transfer system according to the present invention will be explained. A condition is judged that, on the doffing rail 5, a bobbin carriage 10 is located, to which full bobbins are loaded by the doffing system at the front side of the roving frame 2A, and that, based on the signals from the carriage detectors 41J and 41K, one of the sections 8A or 8B of the branched overhead rail 8 is empty. When it is judged that this condition is obtained, the bobbin carriage 10 loaded with full bobbins 11 and moved by the suitable feeder 60 is stopped, on the rail 5, when the detector 41H or 41I detects the arrival of the leading edge of the bobbin carriage 10. When it is determined that both of the carriage detectors 41F and 41G on the second overhead rail 6 detect no bobbin carriage, the switch 25 is operated so that the bobbin carriage 10 from the doffing rail 5 is introduced into the second overhead rail 6 and is moved toward the location where the discriminator 19 is arranged. When it is determined by the discriminator 19 that the bobbin carriage 10 is the one that is provided with full bobbins 11, the bobbin carriage 10 is, via the switches 21 and 22, moved into one of the section 8A or 8B of the rail 8, which is not occupied by a bobbin carriage, and is stopped when the bobbin detector 41J or 41K detects the leading end of the bobbin carriage with full bobbins.

During the above operation, when a condition is detected that both of the sections 8A and 8B of the overhead rail 8 are not empty, the bobbin carriage with full bobbins 11 maintains its stopped condition at the doffing rail 5 until one of the sections 8A and 8B is made free. Furthermore, when the carriage detector 41F or 41G on the second overhead rail 6 detects a carriage which is circulated along the closed loop of the second overhead rail 6, the carriage 10 with full bobbins 11 at the doffing rail 5 as detected by the carriage detector 41I is stopped, thereby preventing the carriage 10 from being introduced into the second overhead rail 6. As a result, the bobbin carriage 10 with full bobbins 11 from the doffing rail 5 is prevented from interfering with a bobbin carriage circulated along the closed path of the second overhead rail 6.

Along the first overhead rail 4 looping around the 13 fine spinning frames 1A to 1M, bobbin carriages 10 are moved by the feeders 60 so that the bobbin carriages 10 are recirculated along the closed loop as shown by an arrow $f_1$. When an operator, who patrols the fine spinning section A, find an empty or nearly empty bobbin on the creel 33 due to the spinning operation at the corresponding spinning machine, the empty bobbin is manually taken out and is exchanged with a full bobbin on a bobbin carriage 10 which is located adjacent the operator and which is moved along the closed loop of the first overhead rail 4. The taken out empty bobbin is hung on the bobbin carriage. Such a type of manually executed bobbin exchange operation by an operation is, usually, called a random bobbin exchange operation. At each time when one full recirculation of the bobbin carriage 10 is completed along the closed loop of the first overhead rail, each of the bobbins hanging from the bobbin carriage is checked, to detect if it is a full bobbin 11 or an empty bobbin 12, by the carriage detector 41 and the bobbin detector 42.

Figures 8A, 8B, 8C, 8D, 8E:
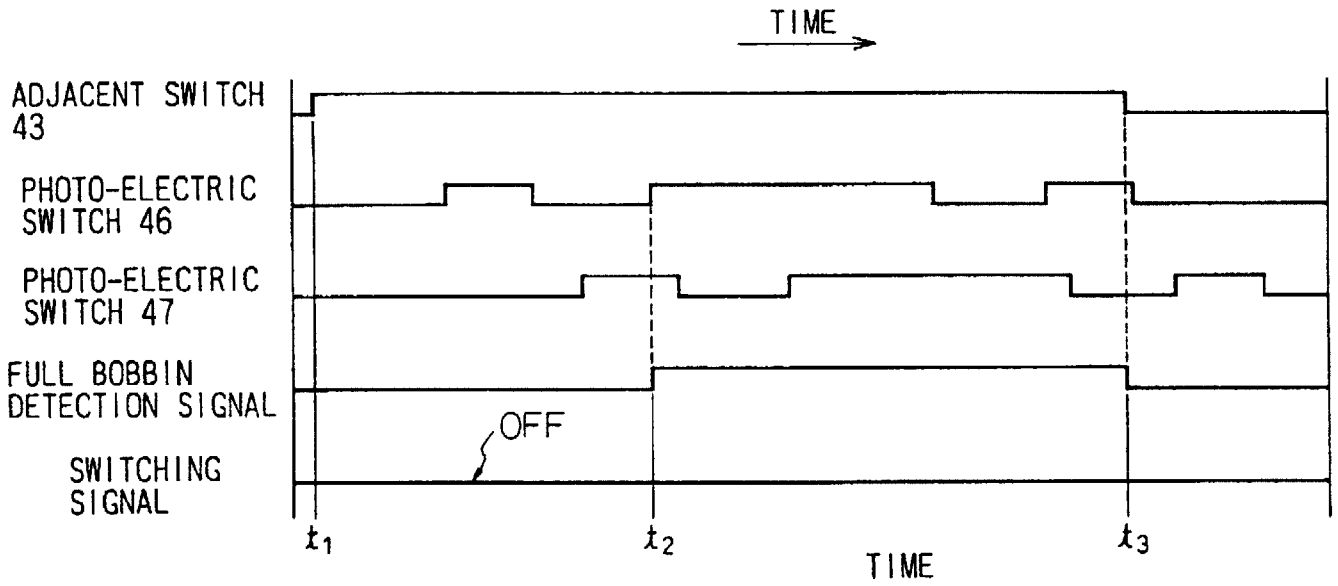
FIGS. 8A to 8E are timing charts illustrating an operation of a switching device when a bobbin carriage includes a full bobbin.
Figure 10:
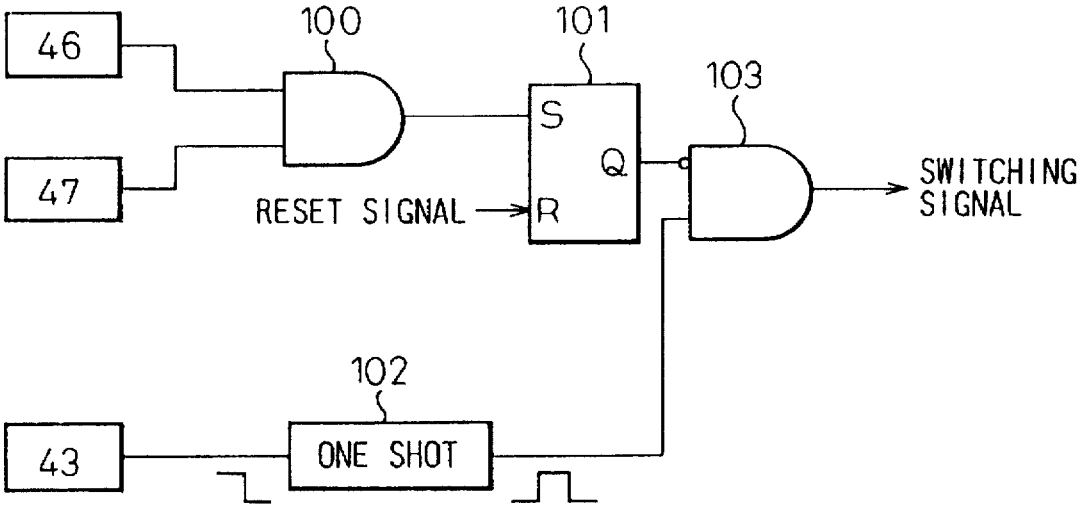
FIG. 10 is a schematic construction of a logic circuit for obtaining the operation in FIGS. 8A to 8E and 9A to 9E.

Switching of the bobbin carriages 10 from the first overhead rail 4 to the return overhead rail 7 via the switching device 16 will be explained with reference to a timing chart in FIGS. 8A to 8E. When a leading end of a carriage bar 31 of a bobbin carriage 10 comes to the location of the adjacent switch 43 of the detector 41 at a time $t_1$, the switch 43 is made ON as shown in FIG. 8A. The photo-electric switches 46 and 47 of the bobbin detector 42 are alternately made ON as shown in FIGS. 8B and 8C during the movement of the bobbin carriage 10, due to the fact that the switches 46 and 47 are facing bobbins on the bobbin carriage 10. When a full bobbin, even if it is only one, is located on the bobbin carriage 10, there exists a timing t2, where both of the photo-electric detectors 46 and 47 are in the respective ON condition, due to the spacing P (FIG. 7) between the detectors 46 and 47 which is smaller than the diameter D' of a full bobbin. As shown in FIG. 10, the detectors 46 and 47 are, at their outputs, connected to an AND gate 100, so that the gate 100 issues, at the timing t2, a full bobbin signal, as shown in FIG. 8D. The AND gate 100 is connected to a flip-flop circuit 101 as a latch circuit, so that the full bobbin signal from the AND gate 100 is prevented from being erased, so long as the bobbin carriage detecting signal is issued from the bobbin carriage detector 43 as shown in FIG. 8A. In other words, the operation of the logic circuit is such that, when a full bobbin 11, even if it is only one, is left on the bobbin carriage, a full bobbin detecting signal is issued as shown in FIG. 8D. When the bobbin carriage 10 leaves the detecting location, the adjacent switch 43 of the bobbin carriage detector 41 which is spaced from the carriage bar 31, causes the adjacent switch 43 to be made OFF at a timing t3, as shown in FIG. 8A. In this case, a one shot circuit 102 turns on for a short period. However, due to the ON condition of the flip-flop 101, an AND gate 103 is made OFF, thereby providing no switching signal as shown in FIG. 8E, which causes the switch 16 to be operated, so that a recirculated movement of the bobbin carriage along the closed loop of the first overhead rail 4 continues.

Figures 9A, 9B, 9C, 9D, 9E:
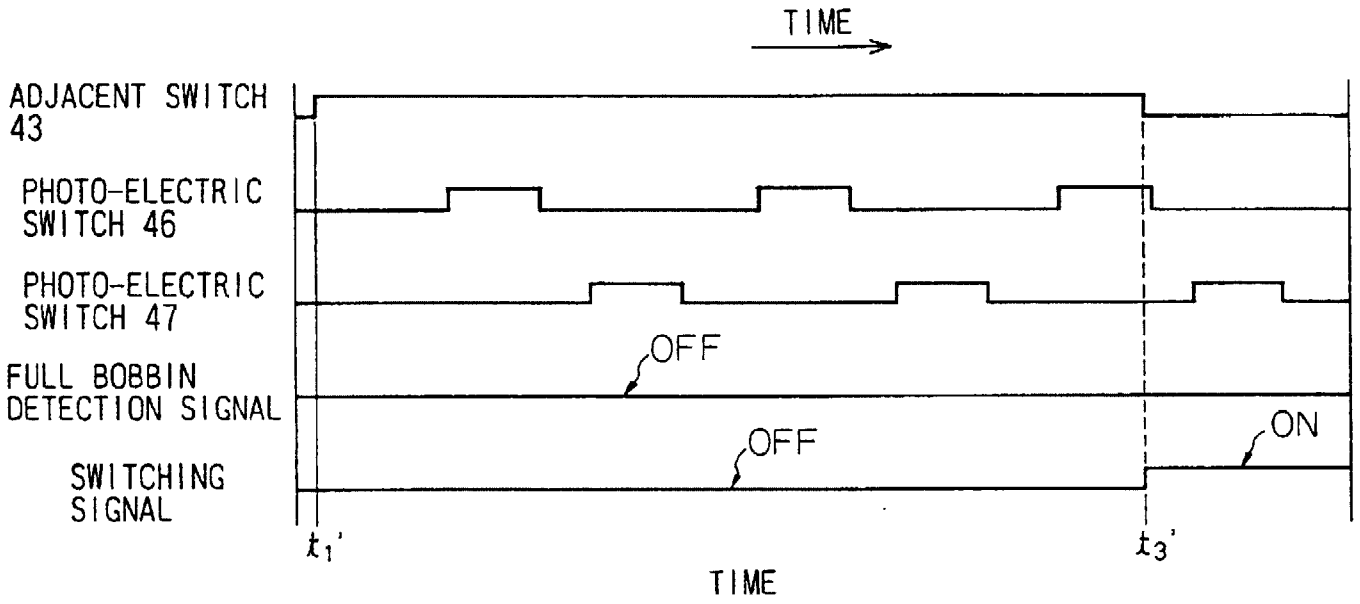
FIGS. 9A to 9E are timing charts illustrating an operation of a switching device when a bobbin carriage includes no full bobbin.

Now, it is assumed that a bobbin carriage 10, with bobbins which are all empty, arrives. The adjacent switch 43 of the bobbin carriage detector 41 turns ON at timing t1'. Since all of the bobbins on a bobbin carriage 10 are empty, the photo-electric switches 46 and 47 are separately made ON, i.e., there is no time at which the ON conditions of the switches 46 and 47 overlap, as shown in FIGS. 9B and 9C. As a result, the flip-flop 101 is not set, thereby not providing a full bobbin signal, as shown in FIG. 9D. When the bobbin carriage 10 departs from the detecting station, the adjacent switch 43 is turned OFF at a timing t3' and the one shot circuit 102 is turned ON. In this case, due to the OFF condition of the flip-flop 101, the AND gate 103 is turned ON, so that a switching signal is issued, at the output of the AND gate 103 as shown in FIG. 9E, which causes the switching device 16 to be operated, so that the bobbin carriage 10 with bobbins, all of which are emptied, is moved, from the first overhead rail 4, to the branched overhead rail 7 as shown by the arrow $f_2$. At the same time, a bobbin carriage 10 with full bobbins 11 waiting at the branched overhead rail 8 commences its movement toward the first overhead rail 4 as shown by an arrow $f_4$. The bobbin carriage 10 with empty bobbins 12 discharged into the branched overhead rail 7 passes, at its trailing end, the carriage detector 41C, which causes the condition of the switch 41C to be changed between an ON and an OFF condition. Such a change of the condition from an ON condition to an OFF condition of the switch 41C causes the switching device 16 to be returned to its usual position, while the flip-flop 101 is reset, so that the logic circuit in FIG. 10 is reset for the arrival of next bobbin carriage 10. On the other hand, the bobbin carriage 10 with empty bobbins 12 moving into the branch rail 7 is stopped at a location which is detected by the detector 41D, so long as the carriage detector 41E along the closed loop of the second overhead rail 6 detects a bobbin carriage. The stoppage of the bobbin carriage by the detector 41D continues until the detector 41E is turned OFF, which prevents the bobbin carriages interfering with each other in the closed loop of the second overhead rail 6. When the switch 41E is turned OFF, the introduction of the bobbin carriage with empty bobbins, from the branched rail 7 to the second overhead rail 7, is allowed.

The bobbin carriage 10 with empty bobbins 12 moves along the second overhead rail 6 as shown by the arrow f3, and arrives at the location of the discrimination device 19. The discrimination device 19 determines if a bobbin at the leading end of the bobbin carriage 10 is empty. When it is determined that the bobbin at the leading end of the carriage is an empty bobbin, i.e., the bobbin carriage 10 is one with empty bobbins 12, the switching device 21 sends the bobbin carriage 10 with empty bobbins 12 along the closed loop of the second overhead rail 6 as shown by an arrow $f_3$.

During the recirculated movement of the bobbin carriage 10 with empty bobbins 12 along the second overhead rail 6, the roving operation at the roving frames 2A and 2B is continued. Upon the completion of the one roving cycle at the roving frame 2A or 2B, i.e., empty bobbins are requested by the roving frame, the bobbin carriage 10 with empty bobbins is introduced into the corresponding doffing rail 5. The full bobbins at the roving frame are exchanged with the empty bobbins on the bobbin carriage 10 on the doffing rail 5.

When a bobbin carriage 10, with empty bobbins, on the incoming overhead rail 7 is detected by the detector 41D, a detection of a bobbin carriage 10, moving along the closed loop of the second overhead rail 6, by the detector 41E causes, first, the corresponding feeder 60 to be stopped. The operation of the feeder is commenced after the completion of an introduction of the bobbin carriage 10 from the incoming rail 7 to the second overhead rail 6. When a bobbin carriage 10 on the doffing rail 5 is detected by the detector 41H or 41I, detection of a bobbin carriage 10 moving along the closed loop of the second overhead rail 6 by the detector 41F or 41G causes, first, the corresponding feeder 60 to be stopped. The operation of the feeder is commenced after the completion of an introduction of the bobbin carriage 10 from the doffing rail 5 to the second overhead rail 6.

The auxiliary bobbin hangers 4' in the fine spinning section 4-1*a* are provided to allow an operator to take full bobbins from the first overhead rail 4 and to put them onto the auxiliary bobbin hangers 4'. When an operator finds that the number of full bobbins left on a bobbin carriage is small, for example 5 or less, the operator takes off the full bobbins from the bobbin carriage 10 and puts them on the adjacent auxiliary bobbin hangers 4'. As a result, arrival of this bobbin at the detecting location causes the detectors 41 and 42 to judge that the bobbin carriage is empty, thereby switching the movement of the bobbin carriage to the branched rail 7. As a result, the efficiency of the bobbin exchange is improved.

Figures 11A, 11B, 11C, 11D, 11E, 11F, 11G:
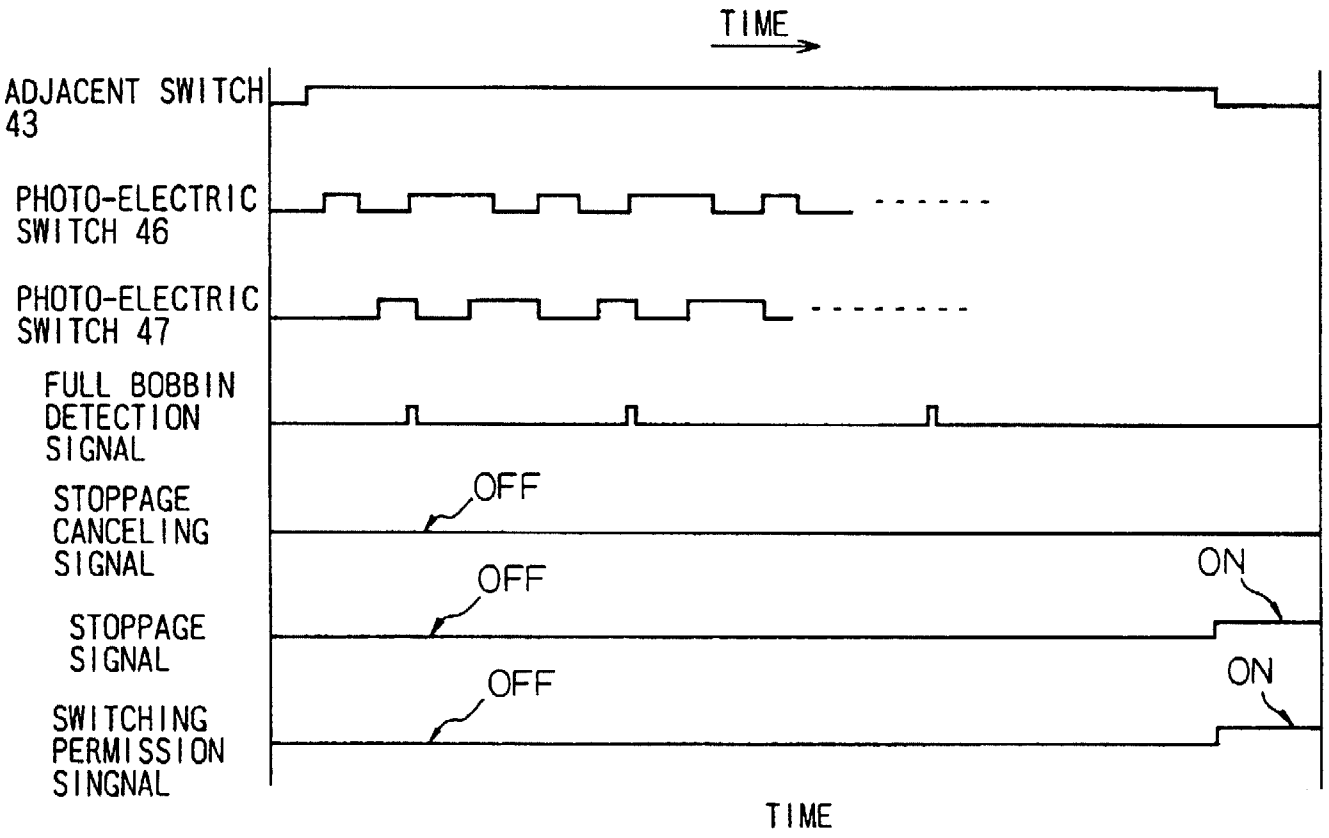
FIGS. 11A to 11G are timing charts illustrating an operation of a switching device when a bobbin carriage includes full bobbins smaller than a predetermined number.
Figure 13:
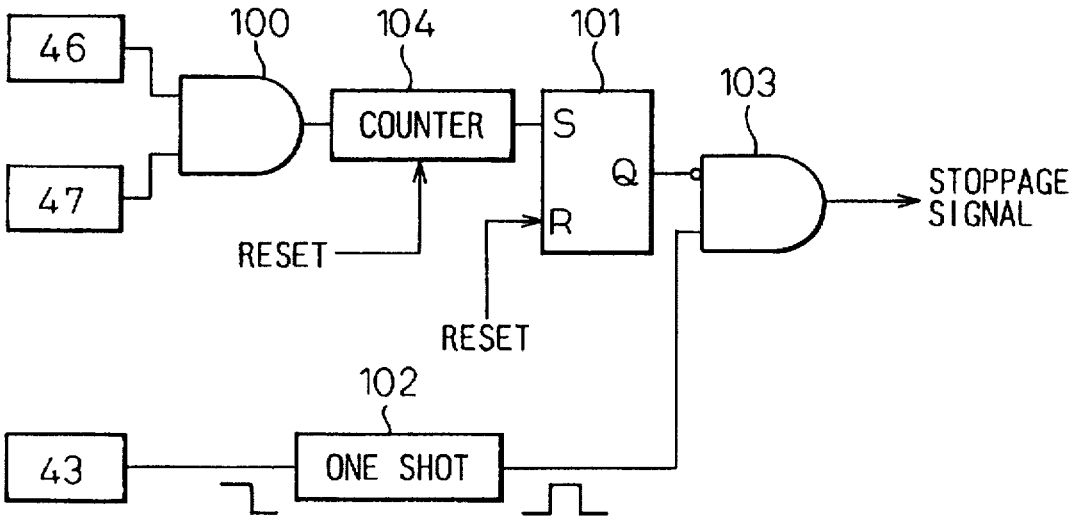
FIG. 13 is a schematic construction of a logic circuit for obtaining the operation in FIGS. 11A to 11G and 12A to 12G.

In a modification of the present invention, when the number of full bobbins on a bobbin carriage 10 is smaller than a predetermined value, such as 5, a signal is issued for causing the bobbin carriage 10 to be stopped, thereby producing an electric signal, which alarms an operator(s) by a light or sound to notify him or her that the number of full bobbins on a bobbin carriage 10 is smaller than 5. Namely, FIGS. 11A to 11G show timing charts illustrating the operation of this modification when the number of full bobbins remaining on a bobbin carriage is larger than a predetermined number n. Namely, a preset counter 104 in FIG. 13 is provided. Namely, as shown in FIG. 11A, the adjacent switch 43 of the detector 41 is made ON when a carriage bar 31 at the leading end of a bobbin carriage 10 faces the switch 43. The photoelectric switches 46 and 47 of the bobbin detector 42 are alternately made ON as shown in FIGS. 11B and 11C during the movement of the bobbin carriage 10, due to the fact that the switches 46 and 47 face bobbins on the bobbin carriage 10. Each time a full bobbin is detected, i.e. both of the switches 46 and 47 are turned ON, a full bobbin signal is issued from an AND gate 100 (FIG. 13) as shown in FIG. 11D. When the number of the full bobbins in the bobbin carriage is smaller than the predetermined number n, the preset counter 104 is turned OFF, so that a flip-flop 101 (stoppage cancel circuit) is reset, so that a stoppage cancel signal is not issued as shown in FIG. 11E and so that a carriage stoppage signal is generated by an AND gate 103, as shown in FIG. 11F, when the adjacent switch 43 is turned OFF and, thus, the one shot circuit 102 is turned ON. As a result, a signal for allowing an operation of the switching device 16 is issued as shown in FIG. 11G, In this case, switching can be done by manually operating the switching device 16. Then, operators exchange the full bobbins remaining on the bobbin carriage with empty bobbins. Then, a restart button (not shown) is depressed by an operator, so that the operation of the feeders 60 is commenced, and an electric signal for operating the switching device 16 is issued, which allows the bobbin carriage with empty bobbins to be returned to the second overhead rail 6 via the branched overhead rail 7 as shown by an arrow $f_2$.

Figures 12A, 12B, 12C, 12D, 12E, 12F, 12G:
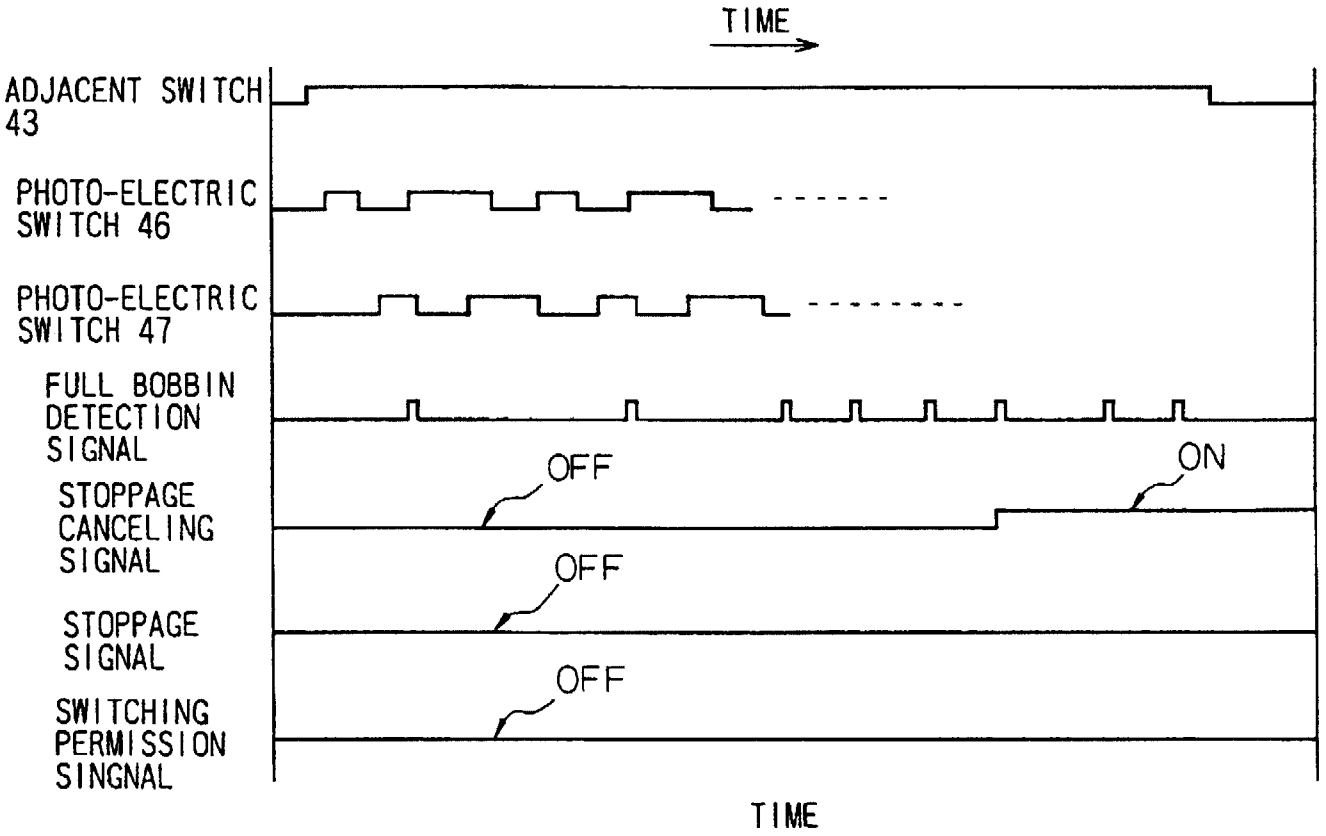
FIGS. 12A to 12G are timing charts illustrating an operation of a switching device in a modification when a bobbin carriage includes a full bobbin larger than the predetermined number.

Contrary to this, when the number of the full bobbins in the bobbin carriage is larger than the predetermined number n, the counter 104 is turned ON, i.e., the flip-flop 101 is set, so that a stoppage cancel signal is issued as shown in FIG. 12E. On the other hand, the AND gate 104 is maintained in the OFF condition, even when the carriage detector 43 made OFF, i.e., when the one shot circuit 102 is made ON, and so that no carriage stoppage signal is generated by the gate 103 as shown in FIG. 12F. As a result, a signal for obtaining an operation of the switching device 16 is not issued, as shown in FIG. 12G.

Figure 14:
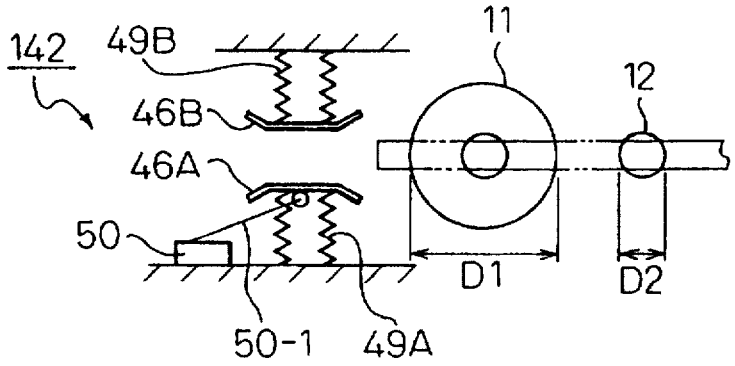
FIG. 14 shows a modification of a bobbin detector.

FIG. 14 shows a modification to a bobbin detector, which includes a pair of detecting plates 46A and 46B spaced in a direction transverse to the direction of the movement of the bobbin carriage. Springs 49A and 49B are provided for generating a force urging the detecting plates 46A and 46B toward each other, so that the latter contact the full bobbins, laterally, with a light force. A limit switch 50 has a feeler 50-1 which is arranged to cooperate with the detecting plate 46A. The detecting plates 46A and 46B have widened ends, so that the movement of a full bobbin 12 causes the plates 46A and 46B to be laterally moved against the force of the springs 49A and 49B, which allows the limit switch 50 to be made ON, thereby detecting the full bobbin 11. Contrary to this, an empty bobbin 12 does not cause the detecting plates 46A and 46B to be laterally moved, thereby preventing the limit switch 50 from being made ON, thereby detecting the empty bobbin.

Furthermore, when the roving frames 2A and 2B produce different kinds of rovings, the main rail 8A of the overhead rail is allocated for the rovings produced by the roving frame 8A, while the sub rail 8B of the overhead rail is allocated for the rovings produced by the roving frame 8B. Furthermore, the bobbin carriages 10 are provided with respective identification marks which indicate the kinds of the rovings carried. When a bobbin carriage 10 with empty bobbins 12 is introduced from the first overhead rail into the second overhead rail, an identification mark on the returned bobbin carriage is detected. A bobbin carriage with full bobbins of the same kind of roving is, then, fed from the second overhead rail to the first overhead rail.

We claim:

1. A conveyor system, for transporting bobbins between a roving operation area provided with at least one roving frame and a fine spinning operation area provided with a plurality of fine spinning frames, comprising:

a plurality of bobbin carriages for carrying bobbins;

first overhead means for conveying bobbin carriages in the fine spinning operation area;

second overhead means for conveying bobbin carriages in the roving spinning operation area;

first branched means for connecting the first and second overhead means for transporting bobbin carriages with the bobbins from the first overhead means to the second overhead means;

second branched means for connecting the first and second overhead means for transporting bobbin carriages with the bobbins from the second overhead means to the first overhead means; and means for moving the bobbin carriages along the first and second overhead means and the first and second branched means;

said first overhead means comprising a first single overhead rail constructing a first single closed loop which loops around the fine spinning frames of the fine spinning operation area for permitting recirculation of the bobbin carriages along the first single closed loop;

said second overhead means comprising a second single overhead rail constructing a second single closed loop which is arranged around the at least one roving frame of the roving spinning operation area for permitting recirculation of the bobbin carriages along the second single closed loop, and at least one doffing rail connected to the second single overhead rail and arranged along the corresponding roving frame;

said fine spinning frames in the fine spinning operation area are arranged in rows, each of the fine spinning frames having a creel for bobbins and spinning parts for roving from corresponding bobbins on the creel;

the first single overhead rail of the first overhead means being a serpentine shape having looped parts that loop around the opposite ends of the rows of fine spinning frames alternately along the direction of movement of the bobbin carriages, and straight parts extending between the looped parts, the direction of the movement of the bobbin carriages being reversed between successive straight parts;

two successive straight parts of the first single overhead rail being arranged adjacent to the creel in one row of said fine spinning frames, and the next adjacent row of said fine spinning frames being without straight parts adjacent to its creel; and stationary auxiliary bobbin hangers being arranged at the creel of said adjacent row that is without adjacent straight parts;

the first branched means including a first single branched rail, so that said first single branched rail is used for the fine spinning frames along the first closed loop for returning empty bobbins to the at least one roving frame along the second closed loop, and the second branched means including a second single branched rail, so that the second single branched rail is used for the fine spinning frames along the first closed loop for receiving full bobbins from the at least one roving frame along the second closed loop.

2. A conveyor system according to claim 1, further comprising:

a switching device arranged between the first overhead means and the first branched means;

the switching device being switched between a first condition where the bobbin carriages are recirculated along the closed loop of the first overhead means and a second condition where the bobbin carriages are taken into, from the first overhead means, the first branched means;

means for determining a necessity for loading full bobbins to a bobbin carriage arranged at a fixed location spaced prior to the switching device in the direction of the movement of the bobbin carriage in the closed loop of the first overhead means, and;

means for operating the switching device so that the latter is switched to the second condition, which allows the bobbin carriage to be introduced into the first branched means from the first overhead rail, when the necessity of loading of full bobbins is determined.

3. A conveyor system according to claim 2, wherein the determining means includes a counter for counting the number of the full bobbins left on the bobbin carriage, and means for allowing the switching device to be switched when it is detected that the number of full bobbins left on the bobbin carriage is reduced to a predetermined number.

4. A conveyor system according to claim 2, wherein the determining means comprises a first detector for detecting the arrival of a leading end of a bobbin carriage and a second detector for detecting the condition of a bobbin as to whether it is a full bobbin or an empty bobbin.

5. A conveyor system according to claim 4, wherein said second detector comprises a pair of photoelectric switches spaced in the direction of movement of the bobbin carriage at a distance smaller than a diameter of a full bobbin and larger than the diameter of an empty bobbin.

6. A conveyor system according to claim 1, wherein each of said bobbin carriages comprises a plurality of carriage members, each of which is provided with bobbin hangers, and means for flexibly connecting the carriage members with each other in series, and wherein said bobbin carriage moving means comprise a plurality of spaced feeders arranged along the first and second overhead means, the spacing between the adjacent feeders being less than the length of a single bobbin carriage, each of the feeders comprising a rotating member which is in contact with the carriage members and a source of a rotating movement to be applied to the rotating member.

7. A conveyor system according to claim 1, wherein the first and second single branched rails in the first and second branched means each have a length larger than the length of a single bobbin carriage.

8. A conveyor system, for transporting bobbins between a roving operation area provided with at least one roving frame and a fine spinning operation area provided with a plurality of fine spinning frames, comprising:

a plurality of bobbin carriages for carrying bobbins;

a first overhead means for conveying bobbin carriages in the fine spinning operation area;

second overhead means for conveying bobbin carriages in the roving spinning operation area;

first branched means for connecting the first and second overhead means for transporting bobbin carriages with the bobbins from the first overhead means to the second overhead means;

second branched means for connecting the first and second overhead means for transporting bobbin carriages with the bobbins from the second overhead means to the first overhead means;

means for moving the bobbin carriages along the first and second overhead means as well as the first and second branched means;

said first overhead means comprising a first single overhead rail constructing a first single closed loop which loops over the fine spinning frames of the fine spinning operation area for permitting recirculation of the bobbin carriages along the first single closed loop;

said second overhead means comprising a second single overhead rail constructing a second single closed loop which is arranged around the at least one roving frame of the roving spinning operation area for permitting recirculation of the bobbin carriages along the second single closed loop, and at least one doffing rail connected to the second single overhead rail and arranged along the corresponding roving frame;

a switching device arranged between the first overhead means and the first branched means;

the switching device being switched between a first condition where the bobbin carriages are recirculated along the closed loop of the first overhead means and a second condition where the bobbin carriages are taken from the first overhead means into the first branched means;

means for determining a necessity for loading full bobbins to a bobbin carriage arranged at a fixed location spaced prior to the switching device in the direction of the movement of the bobbin carriage in the closed loop of the first overhead means, the determining means comprising a first detector for detecting the arrival of a leading end of a bobbin carriage and a second detector for detecting the condition of a bobbin as to whether it is a full bobbin or an empty bobbin, the second detector comprising a pair of spring loaded plates spaced in a direction transverse to the movement of the bobbin carriage at a distance smaller than a diameter of a full bobbin and larger than the diameter of an empty bobbin, and an electrical switch connected to at least one of the plates;

means for operating the switching device so that the latter is switched to the second condition, which allows the bobbin carriage to be introduced into the first branched means from the first overhead rail, when the necessity of loading of full bobbins is determined.

* * * * *